US006123994A

United States Patent [19]

Ito et al.

[11] Patent Number: 6,123,994

[45] Date of Patent: Sep. 26, 2000

[54] INK-JET RECORDING HEAD AND A PRODUCTION METHOD OF THE SAME

[75] Inventors: Takeshi Ito; Hideo Watanabe; Hiroyuki Nomori, all of Hino, Japan

[73] Assignee: Konica Corporation, Tokyo, Japan

[21] Appl. No.: 09/296,087

[22] Filed: Apr. 21, 1999

[30] Foreign Application Priority Data

Apr. 27, 1998 [JP] Japan ..... 10-116718

[51] Int. Cl.[7] ..... B05D 3/10

[52] U.S. Cl. ..... 427/333; 427/302; 427/353; 427/412.1; 427/412.3; 427/412.5

[58] Field of Search ..... 427/2.28, 2.3, 427/302, 352, 353, 333, 412.1, 412.3, 412.5, 393.4

[56] References Cited

U.S. PATENT DOCUMENTS

| | | | |
|---|---|---|---|
| Re. 31,764 | 12/1984 | Voss et al. | 427/3 |
| 5,612,725 | 3/1997 | Okimoto | 347/71 |
| 5,702,754 | 12/1997 | Zhong | 427/2.12 |

*Primary Examiner*—Shrive Beck
*Assistant Examiner*—Jennifer Calcagni
*Attorney, Agent, or Firm*—Frishauf, Holtz, Goodman, Langer & Chick, P.C.

[57] ABSTRACT

An ink-jet recording head employed in an ink-jet recording apparatus is disclosed. A part of the channel is composed of resin material which comprises a base resin and a highly cationic resin attached on the surface of the base resin through reaction, the resulting surface being reacted with a hydrophilic organic material. A production method of the head, an ink-jet recording apparatus and production method of the ink-jet recording apparatus are also disclosed.

22 Claims, 2 Drawing Sheets

INK-JET RECORDING HEAD AND A PRODUCTION METHOD OF THE SAME

BACKGROUND OF THE INVENTION

The present invention relates to a resin-made ink-jet recording head employed in an ink-jet recording apparatus and a production method of the same.

As compared with glass and metal, resins are advantageously employed for making an ink-jet recording head so that machining and assembling can be easily carried out and the production costs can be reduced.

However, when water-based ink is employed in an ink-jet recording head made of resins because the resin surface is highly water-resistant, wettability of the water-based ink decreases in contact with a resin part. Thus, when the ink is introduced into the head, bubbles remain in an ink passage, or bubbles generated in the passage tend not to be ejected even though the ejection operation is carried out. Such remaining bubbles result in decreased ink ejection and at the worst case, no dots are printed.

Accordingly, in order to improve the wettability of the resin surface of the ink passage, Japanese Patent Publication Open to Public Inspection No. 60-24957 proposes to carry out a hydrophilic treatment which generates a polar group on the surface of the resin, employing an acid treatment, plasma treatment, etc. Further, Japanese Patent Publication Open to Public Inspection No. 2-54784 proposes that while an aqueous dye solution is in contact with the surface of an ink passage, humidification is carried out and wettability is improved by previously allowing dye to adsorb onto or penetrate into the surface of the passage. Furthermore, a method is proposed in which wettability is improved by surface-grafting a hydrophilic polymer on the surface of the passages which is in contact with ink.

SUMMARY OF THE INVENTION

However, the first of the above-described methods of hydrophilic treatments of the resin surface are only temporarily effective and lack extended effectiveness. Therefore, when the ink-jet recording head is not kept filled with ink, effects of the hydrophilic treatment in the ink passage are lost.

In one method in the second of the above-described methods, the polar group on the surface is enlarged to minimize its burying and thus the continued effects of the hydrophilic treatment can be expected. However, when the grafting treatment is carried out after assembling, it is very difficult to treat all the complicated ink passage and furthermore, the treatment affects the wettability of the channel surface to occasionally vary the ejection properties. Furthermore, even when the grafting treatment is carried out prior to assembling, upon employing an adhesive, the treatment is subjected to effects due to the water-repellence of the adhesive.

The present invention is accomplished to solve the above-mentioned problems. An object of the present invention is to provide an ink-jet recording head which can minimize various problems due to bubbles in an ink passage by permanently maintaining hydrophilicity in the ink passage of the ink-jet recording head; and a production method of the same.

The invention and embodiments thereof are described below.

An ink-jet recording head employed in an ink-jet recording apparatus according to the present invention has a channel in which ink is capable of being supplied and a driver which drives ink through the channel. A part of the channel is composed of resin material which comprises a base resin and a highly cationic resin attached on the surface of the base resin through reaction, the resulting surface being reacted with a hydrophilic organic material.

The part of the head which contacts with the ink is preferably composed of the resin material in the channel.

The above-mentioned hydrophilic organic material is preferably a resin which comprises acid anhydride in its structure.

The above-mentioned hydrophilic organic material is preferably a resin which comprises a carboxyl group in its structure.

The above-mentioned hydrophilic organic material is preferably an acrylic series monomer which comprises acid anhydride in its structure.

The production method of an ink-jet recording head employed in an ink-jet recording apparatus according to the invention comprises steps of, attaching a highly cationic resin on the surface of the channel composed of a base resin, and subjecting a resulting surface to react with a hydrophilic organic material.

The method preferably comprises further steps of, washing at least a part whose surface is subjected to react with a hydrophilic organic material after the step of subjecting a resulting surface to react with a hydrophilic organic material, immersing at least a part whose surface is subjected to react with a hydrophilic organic material in liquid containing alkali metal, and washing at least a part immersed in liquid containing alkali metal employing deionized water.

In the production method the above-mentioned hydrophilic organic material is preferably a resin which comprises acid anhydride in its structure.

The above-mentioned hydrophilic organic material is preferably a resin which comprises a carboxyl group in its structure.

The above-mentioned hydrophilic organic material is preferably an acrylic series monomer which comprises acid anhydride in its structure.

An ink-jet recording apparatus according to the present invention has an ink-jet recording head, a channel and a driver which drives ink through the channel, and a control means controlling the driver according to image data. A part of the channel is composed of resin material which comprises a base resin and a highly cationic resin attached on the surface of the base resin through reaction, the resulting surface being reacted with a hydrophilic organic material.

A production method of an ink-jet recording apparatus including an ink-jet head according to the present invention includes for preparing the ink-jet recording head, the steps of, attaching a highly cationic resin on the surface of the channel composed of a base resin, and subjecting a resulting surface to reaction with a hydrophilic organic material.

The surface treatment employing a resin may be carried out prior to assembling materials of the main constitution elements of the present ink-jet recording head and may be carried out after assembly in the treatment-permitting range.

The preferable embodiment of the invention is disclosed.

(1) In an ink-jet recording head employed in an ink-jet recording apparatus, an ink-jet recording head characterized in that a part in contact with ink is composed of a resin, a highly cationic resin is attached on the said resin surface through reaction, and a hydrophilic organic material is allowed to react with the resulting surface.

(2) The ink-jet recording head described in (1), characterized in that the above-mentioned hydrophilic organic material is a resin which comprises acid anhydride in its structure.

(3) The ink-jet recording head described in (1), characterized in that the above-mentioned hydrophilic organic material is a resin which comprises a carboxyl group in its structure.

(4) The ink-jet recording head described in (3), characterized in that the above-mentioned hydrophilic organic material is an acrylic series monomer which comprises acid anhydride in its structure.

(5) In a production method of an ink-jet recording head employed in an ink-jet recording apparatus, a production method of an ink-jet recording head characterized in that said recording head is produced in such a manner that a highly cationic resin is attached on the surface of a part composed of a resin in contact with ink through reaction, and a hydrophilic organic material is allowed to react with the resulting surface.

(6) The production method of an ink-jet recording head described in (5), characterized in that the above-mentioned hydrophilic organic material is allowed to react with a surface, the resulting surface is cleaned, and thereafter, is immersed in liquid containing alkali metal and then washed employing deionized water.

DETAILED DESCRIPTION OF THE INVENTION

Figure 1:
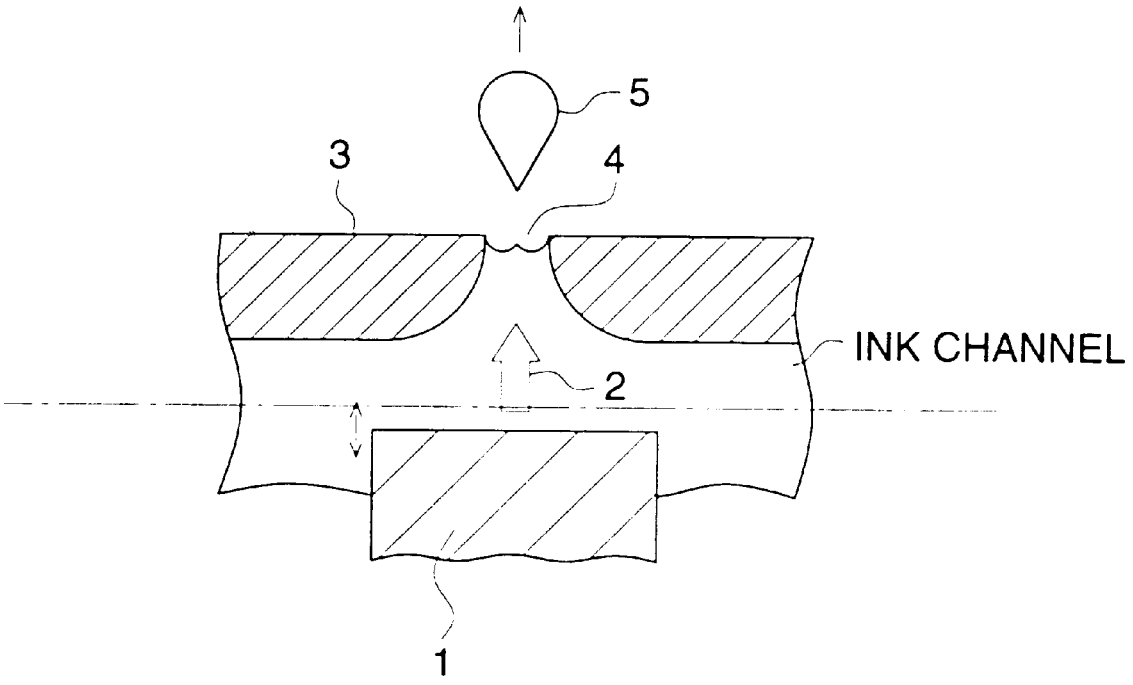
FIG. 1 is a schematic view showing the ink ejection principle of the ink-jet head of the present invention.
Figure 2:
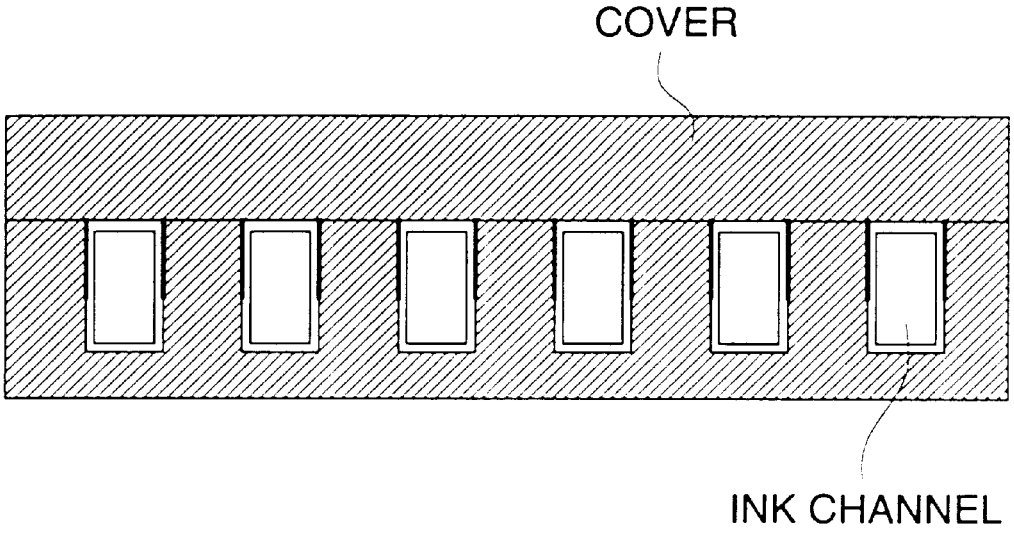
FIG. 2 is cross sectional view of an ink channel cut through one-dot-lines.

The ink ejection principle of the ink-jet recording head of the present invention, as shown schematically in FIG. 1, is that ink 2 pressurized by the displacement of driving part 1 is injected by channel 4 of channel plate 3 to form ink droplet 5. Further, the ink-jet head of the present invention comprises an ink flow passage, an ink introduction passage which supplies ink to the ink flow passage, and a channel plate having a channel in the position corresponding to the ink flow passage and the driving part is provided with an electrode layer and a resin layer in this order on a piezoelectric ceramic substrate.

The driver 1 is controlled according to image data by control means, not shown in the drawing. Ink is expelled through the channel 4 corresponding to the image data by this means and the image is recorded on a recording medium.

The present invention will be described below.

In the present invention, materials for the ink-jet recording head include, for example, polyethylene, polypropylene, polystyrene, ABS resins, polyethylene terephthalate, polysulfone, polyamide, polyacetal, polycarbonate, polymethyl methacrylate, polyimide, polyacrylate, fluorine series polymers, urea resins, melamine resins, phenol resins, etc.

Polyimide is preferably employed for the channel plate. Polyparaxylylene is preferably employed for forming a channel.

In the present invention, a part which in contact with ink is composed of a resin, and the head itself is made of any of the above-mentioned resins; that in which any of the above-mentioned resins is coated onto another material, or that in this case, in contact with ink.

The surface of these resins which will be in contact with ink is preferably activated by treatments employing plasma, ozone, corona discharging, etc. before being allowed to react with a resin having highly cationic properties. Plasma treatment is especially preferable.

Representative of the plasma treatment is the process described below as an example.

(Treatment Conditions)

Apparatus: parallel flat plate type reaction apparatus

Raw gas: oxygen

Gas flow amount: 50 sccm

Pressure: 10 Pa

Discharge method: high frequency (13.56 MHz, output 200 w)

Treatment time: 2 minutes

As a particularly effective plasma treatment, a method employing a microwave is listed. The employed gas includes oxygen, nitrogen, argon, carbonic acid gas, ammonia, or other gases or mixed gas of oxygen and inert gas, etc.

Preferable examples of the gas employed in this process include oxygen, argon, carbon dioxide and nitrogen. Among these the most preferable one is oxygen, especially preferable is gas having an oxygen content of not less than 90%. The gas pressure is preferably not more than 50 Pa, more preferably not more than 30 Pa.

The highly cationic polymer in the present invention, when dissolved in water, is positively charged. The polymers include, for example, polyethylene imine, polyallyl amine, polyvinyl amine, etc., though not limited to these. The molecular weight is preferably at least 100 in terms of Mn, and is more preferably between 1,000 and 100,000 in terms of Mn.

The highly cationic resin is allowed to react with a functional group (—COOH, —OH, —OOH, etc.) present on the surface of a resin part of an ink-jet recording head and which was previously subjected to plasma treatment, ozone treatment, corona discharging treatment, etc., whereby the cationic resin is fixed on the surface of the resin part.

In order to allow the highly cationic resin to react, an aqueous polyethylene imine or polyallyl amine solution as a representative example, is coated and dried. After thermal treatment at not less than 40° C., the coating is washed employing deionized water, or after immersing in the above-mentioned aqueous solution, can be washed employing deionized water. In this case, an aqueous solution having a concentration of about 0.01 to about 5 percent is often employed.

The hydrophilic organic materials as described herein include a) resins comprising acid anhydride, b) resins having a carboxyl group, or c) acrylic series monomers having a carboxylic group, etc. The resins comprising acid anhydride include copolymers containing maleic anhydride such as methyl vinyl ether/maleic anhydride alternating copolymer, etc.; the resins having a carboxyl group include acrylic acids, such as polyacrylic acid, polymethacrylic acid, etc., and copolymers of monomers having a carboxyl group such as methacrylic acid, etc. with other acrylic acid series monomers; acrylic series monomers include acrylic acid, methacrylic acid, etc., however, the present invention is not limited to these. Regarding copolymers, a copolymerization ratio of (construction unit comprising acid anhydride): (construction unit of others) or (construction unit having a carboxyl group):(construction unit of others) is preferably 1:99 to 100:0, and is more preferably 10:90 to 100:0.

The molecular weight of the hydrophilic organic material is preferably between 1,000 and 10,000,000 in terms of Mn, and is more preferably between 10,000 and 1,000,000.

When an acrylic acid series monomer is employed as the hydrophilic organic material, Mn of a highly cationic resin is preferably at least 10,000. The hydrophilic organic material is fixed on the surface of a resin in such a way that acid anhydride, and a carboxyl group, or an active double bond of the acrylic series monomer contained in the hydrophilic organic material react with the highly cationic resin existing on the surface of the resin part of an ink-jet recording head.

The hydrophilic organic material can be involved in the reaction in such a manner that, for example, an aqueous solution of methyl vinyl ether-maleic anhydride alternating copolymer, carboxyvinyl polymer and methacrylic acid is coated and dried, and the resulting coating is subjected to thermal treatment at least 40° C., and thereafter, is washed using deionized water, or after being immersed in the above-mentioned aqueous solution, washing is carried out employing deionized water.

After the hydrophilic organic material is allowed to react with a resin, washing using an alkali metal-containing liquid and drying are preferably carried out so that the hydrophilic treatment is stabilized and its effects longer lasting. At the time, the alkali metal-containing liquid is preferably alkaline. The preferred representative alkali metals are sodium and potassium.

Ink applied to the ink-jet recording head of the present invention is an water-based ink, preferably comprising 3 to 20 weight percent of dyes, dispersed dyes or dispersed pigments as colorants; in many cases, 0.05 to 5 weight percent (in the case of dispersion type, 20 to 120 weight percent of dispersing aids to colorants) of anionic, nonionic, or cationic surface active agents; 0.01 to 5 weight percent of urea or amines as humecants; and 5 to 70 weight percent of polyhydric alcohols or ether derivatives thereof as solvents. Of these, those of anionic series or nonionic series as the surface active agents, and polyhydric alcohols or ether derivatives thereof are advantageously employed in order to supplement the ejecting properties of the ink-jet recording head of the present invention.

As colorants, those known in the art can be employed.

EXAMPLES

The present invention will be described in detail with reference to examples below.

A polymer-modifying treatment of an ink passage and a channel was carried out as described below. This treatment was carried out in a device wherein a driving part and a channel plate are adhered together.

Example 1

Masking tape was adhered to the part which was not intended to be subjected to a polymer-modifying treatment so that the part was protected. Then, a plasma treatment (Oxygen content 99.9%, 30 Pa, 200 W and 5 minutes) was carried out and a 1% aqueous solution of polyethylene imine (product name: Epomin P-1000, Nihon Shokubai) was coated and dried.

Next, a 0.5% aqueous solution of a methyl vinyl ether-maleic anhydride alternating copolymer (product name: GANTREZ AN-169, manufactured by International Specialty Products Inc.) was coated and dried. After baking at 60° C. for 8 hours, washing was carried out employing deionized water at 100° C. and drying was carried out.

Example 2

The member in which the part not intended to be subjected to polymer-modifying treatment was protected with masking tape, was subjected to a plasma treatment (Oxygen content 99.9%, 30 Pa, 200 W and 5 minutes) and was coated with a 1% aqueous solution of polyallyl amine (product name: PAA-H, Nitto Boseki), and subsequently dried.

After baking at 60° C. for 5 hours, washing was carried out employing a 0.1N hydrochloric acid solution. After rinsing well with deionized water, drying was carried out. Next, a 0.5% aqueous solution of a methyl vinyl ether-maleic anhydride alternating copolymer (product name: GANTREZ AN-169, manufactured by International Specialty Products Inc.) was coated and dried. After baking at 60° C. for 8 hours, washing was carried out with deionized water at 100° C. and drying was carried out.

Example 3

The member in which the part not intended to be subjected to polymer-modifying treatment was protected with masking tape, was subjected to a plasma treatment (Oxygen content 99.9%, 30 Pa, 200 W and 5 minutes) and was immersed in a 1% aqueous solution of polyethylene imine (product name: Epomin P-1000, Nihon Shokubai) at 80° C. for 30 minutes. The resulting member was taken out and was well washed with deionized water. Thereafter, it was immersed in a 0.5% aqueous solution of a methyl vinyl ether-maleic anhydride alternating copolymer (product name: GANTREZ AN-169, manufactured by International Specialty Products Inc.) at 60° C. for 30 minutes. The resulting member was well washed with deionized water and dried.

Example 4

A member in which the part not intended to be subjected to polymer-modifying treatment was protected with masking tape, was subjected to a plasma treatment (Oxygen content 99.9%, 30 Pa, 200 W and 5 minutes) and was immersed in a 1% aqueous solution of polyallyl amine (product name: PAA-H, Nitto Boseki) at 80° C. for 30 minutes.

The resulting member was taken out and was well washed with deionized water. Thereafter, it was immersed in a 0.5% aqueous solution of a methyl vinyl ether-maleic anhydride alternating copolymer (product name: GANTREZ AN-169, manufactured by International Specialty Products Inc.) at 60° C. for 30 minutes. The resulting member was well washed with deionized water and dried.

Example 5

A member in which the part not intended to be subjected to polymer-modifying treatment was protected with masking tape, was subjected to a plasma treatment (Oxygen content 99.9%, 30 Pa, 200 W and 5 minutes) and was immersed a 1% aqueous solution of polyethylene imine (product name: Epomin P-1000, Nihon Shokubai)at 80° C. for 30 minutes.

The resulting member was taken out and was well washed with deionized water. Thereafter, it was immersed in a 0.5% aqueous solution of carboxyvinyl polymer (Wako Junyaku) at 60° C. for 30 minutes. Then the resulting member was well washed with deionized water and dried.

Example 6

A member in which the part not intended to be subjected to polymer-modifying treatment was protected with masking tape, was subjected to a plasma treatment (Oxygen content 99.9%, 30 Pa, 100 W and 20 minutes) and was immersed a 1% aqueous solution of polyethylene imine (product name: Epomin P-1000, Nihon Shokubai) at 80° C. for 30 minutes.

The resulting member was taken out and was well rinsed with deionized water and washed. Thereafter, it was immersed in a 10% aqueous methacrylic acid solution at 60° C. for 30 minutes. Then the resulting member was well washed with deionized water and dried.

Examples 7 Through 12

Each of Examples 1 through 6 was allowed to react with a hydrophilic organic material and was washed. Thereafter, it was immersed in an aqueous 0.1N NaOH solution for 2 minutes, was well washed with deionized water, and dried.

Comparative Example 1

A member in which the part not intended to be subjected to polymer-modifying treatment was protected with masking tape, was subjected to a plasma treatment (Oxygen content 99.9%, 30 Pa, 200 W and 5 minutes). A 1% aqueous solution of polyethylene imine (product name: Epomin P-1000, Nihon Shokubai) was coated and dried. After baking the resulting member at 60° C. for 5 hours, it was washed with an aqueous 1N hydrochloric acid solution at 100° C., was then well rinsed with deionized water, and dried.

Comparative Example 2

A member in which the part not intended to be subjected to polymer-modifying treatment was protected with masking tape, was subjected to a plasma treatment (Oxygen content 99.9%, 30 Pa, 200 W and 5 minutes). A 1% aqueous polyallyl amine solution was coated and dried. After baking the resulting member at 60° C. for 5 hours, it was washed with an aqueous 1N hydrochloric acid solution at 100° C., was then well rinsed with deionized water, and dried.

Comparative Example 3

A member in which the part not intended to be subjected to polymer-modifying treatment was protected with masking tape, was subjected to a plasma treatment (Oxygen content 99.9%, 30 Pa, 200 W and 5 minutes), and was then immersed in 0.5% aqueous methyl vinyl ether-maleic anhydride copolymer solution at 60° C. for 30 minutes. The resulting member was well washed with deionized water and dried.

Comparative Example 4

A member in which the part not intended to be subjected to polymer-modifying treatment was protected with masking tape, was subjected to a plasma treatment (Oxygen content 99.9%, 30 Pa, 200 W and 5 minutes), and was then immersed in 1% polyethylene imine solution at 80° C. for 30 minutes. The resulting member was well washed with deionized water and dried. The resulting member was taken out and was well rinsed with deionized water. Thereafter, it was immersed in a 10% aqueous acrylamide solution at 60° C. for 30 minutes. Then the resulting member was well washed with deionized water and dried.

Comparative Example 5

A member in which the part not intended to be subjected to polymer-modifying treatment was protected with masking tape, was subjected to a plasma treatment (Oxygen content 99.9%, 30 Pa, 200 W and 5 minutes).

After the treatment of Examples and Comparative Examples, ink was filled into a mounted head from the ink tank and the amount of ink consumption until ejection became possible was measured. In addition, the ink was filled from the ink tank into a head which was stored at normal temperature and pressure for one month, and the amount of ink consumption until normal ejection became possible was evaluated. The less the ink consumption, the better is the performance.

TABLE 1

| | Ink Consumption in cc | |
|---|---|---|
| | Initial | After one month storage |
| Example 1 | 1.0 | 1.5 |
| Example 2 | 1.1 | 1.6 |
| Example 3 | 0.8 | 0.9 |
| Example 4 | 0.9 | 1.0 |
| Example 5 | 1.0 | 1.1 |
| Example 6 | 1.1 | 1.2 |
| Example 7 | 1.0 | 1.0 |
| Example 8 | 1.1 | 1.1 |
| Example 9 | 0.8 | 0.8 |
| Example 10 | 0.9 | 0.9 |
| Example 11 | 1.0 | 1.0 |
| Example 12 | 1.2 | 1.2 |
| Comparative Example 1 | 2.6 | 4.1 |
| Comparative Example 2 | 2.7 | 4.3 |
| Comparative Example 3 | 4.0 | 4.2 |
| Comparative Example 4 | 2.5 | 3.8 |
| Comparative Example 5 | 1.0 | 5.8 |

As can be clearly seen from Table 1, Examples 1 through 12 in the present invention reveals that there are many cases in which the ink consumption until normal ejection becomes possible is small compared to Comparative Examples 1 through 5. Further, it should be noted regarding the properties after one-month storage that the properties of Examples in the present invention are almost similar to those before storage without any exception, while as for Comparative Examples, those which show good properties prior to storage are greatly degraded after the storage.

Specifically, it is found that Examples 7 through 12 which are immersed in an aqueous 0.1N NaOH solution after the treatment and washed employing deionized water exhibit excellent properties.

According to the present invention, it is possible to provide an ink-jet recording head which can minimize problems due to various bubbles in an ink passage by permanently maintaining the hydrophilicity in the ink passage of an ink-jet recording head, and production method of the same.

What is claimed is:

1. A production method for producing an ink-jet recording head for water-based ink for use in an ink-jet recording apparatus, said ink jet recording head having a channel into which ink is supplied, at least a part of the channel having a base resin which contacts the ink, said method comprising the steps of attaching a cationic resin onto the surface of a part of the base resin of the channel which contacts the ink, by reaction, and, thereafter reacting a hydrophilic organic material with the attached cationic resin, wherein the cationic resin becomes capable of being positively charged when dissolved in water.

2. The production method of claim 1 wherein the method further comprises, washing the surface reacted with the hydrophilic organic material, thereafter immersing the surface reacted with the hydrophilic organic material in liquid containing alkali metal, and thereafter washing the surface which was immersed in liquid containing alkali metal with deionized water.

3. The production method of claim 1 wherein the hydrophilic organic material is a resin which comprises acid anhydride in its structure.

4. The production method of claim 1 where in the hydrophilic organic material is a resin which comprises a carboxyl group in its structure.

5. The production method of claim 1 wherein the hydrophilic organic material is an acrylic series monomer which has a carboxyl group in its structure.

6. The production method of claim 1, further comprising: immersing the surface reacted with the hydrophilic organic material in liquid containing alkali metal.

7. The production method of claim 1, further comprising: treating the surface of the part of the base resin of the channel so as to activate the surface of the part of the base resin of the channel before attaching the cationic resin.

8. The production method of claim 7, wherein the treatment employs plasma, ozone or corona discharging.

9. The production method of claim 1, wherein the cationic resin is attached by coating an aqueous solution comprising the cationic resin on the surface of the part of the base resin of the channel.

10. The production method of claim 8, wherein the treatment employs plasma discharging.

11. The production method of claim 1, wherein the cationic resin is attached on the surface so that the cationic resin is reacted with a functional group of the surface, and the hydrophilic organic material is reacted with the surface so that the hydrophilic organic material is reacted with the cationic resin attached on the surface.

12. A production method for producing an ink-jet recording apparatus including an ink-jet head for water-based ink, the ink-let head having a channel into which ink is supplied, at least a part of the channel having a base resin surface which contacts the ink, the production method comprising steps of attaching a cationic resin on the surface of a part of a base resin of the channel which contacts the ink, by reaction, and thereafter reacting a hydrophilic organic material with the attached cationic resin, by reaction, wherein the cationic resin becomes capable of being positively charged when dissolved in water.

13. The production method of claim 12 wherein the method further comprises, washing the surface reacted with the hydrophilic organic material, thereafter immersing the surface reacted with the hydrophilic organic material in liquid containing alkali metal, and thereafter washing the surface which was immersed in liquid containing alkali metal with deionized water.

14. The production method of claim 12 wherein the hydrophilic organic material is a resin which comprises acid anhydride in its structure.

15. The production method of claim 12 wherein the hydrophilic organic material is a resin which comprises a carboxyl group in its structure.

16. The production method of claim 12 wherein the hydrophilic organic material is an acrylic series monomer which has a carboxyl group in its structure.

17. The production method of claim 12, further comprising: immersing the surface reacted with the hydrophilic organic material in liquid containing alkali metal.

18. The production method of claim 12, further comprising: treating the surface of the part of the base resin of the channel so as to activate the surface of the part of the base resin of the channel before attaching the cationic resin.

19. The production method of claim 18, wherein the treatment employs plasma, ozone or corona discharging.

20. The production method of claim 12, wherein the cationic resin is attached by coating an aqueous solution comprising the cationic resin on the surface of the part of the base resin of the channel.

21. The production method of claim 19, wherein the treatment employs plasma discharging.

22. The production method of claim 12, wherein the cationic resin is attached on the surface so that the cationic resin is reacted with a functional group of the surface, and the hydrophilic organic material is reacted with the surface so that the hydrophilic organic material is reacted with the cationic resin attached on the surface.

* * * * *